US007331074B2

(12) United States Patent
Wu

(10) Patent No.: US 7,331,074 B2
(45) Date of Patent: Feb. 19, 2008

(54) INFLATABLE PAD ASSEMBLY

(76) Inventor: Hsin-Tasi Wu, 1F, No. 19, Alley 3, Lane 106, Sec. 3, Min-Chuan E. Rd., Taipei City (TW)

( * ) Notice: Subject to any disclaimer, the term of this patent is extended or adjusted under 35 U.S.C. 154(b) by 0 days.

(21) Appl. No.: 11/496,883

(22) Filed: Jul. 31, 2006

(65) Prior Publication Data

US 2007/0169273 A1 Jul. 26, 2007

(30) Foreign Application Priority Data

Jan. 26, 2006 (CN) ..... 2006 2 0054696

(51) Int. Cl.
*A47C 27/10* (2006.01)
*A47C 17/04* (2006.01)

(52) U.S. Cl. ..... 5/706; 5/723; 5/12.1; 5/922

(58) Field of Classification Search ..... 5/706, 5/710, 722, 723, 12.1, 12.2, 922; 297/452.41
See application file for complete search history.

(56) References Cited

U.S. PATENT DOCUMENTS

| | | | | |
|---|---|---|---|---|
| 2,247,667 | A * | 7/1941 | Rosberger | 5/723 |
| 2,548,547 | A * | 4/1951 | Melrose | 5/723 |
| 3,656,193 | A * | 4/1972 | Schneider et al. | 5/308 |
| 3,890,658 | A * | 6/1975 | Petersilie | 5/2.1 |
| 4,443,901 | A * | 4/1984 | Zimmerman | 5/28 |
| 4,905,332 | A * | 3/1990 | Wang | 5/655.3 |
| 6,042,186 | A * | 3/2000 | Kojic et al. | 297/452.41 |
| 6,886,204 | B2 * | 5/2005 | Kasatshko et al. | 5/722 |

* cited by examiner

*Primary Examiner*—Alexander Grosz
(74) *Attorney, Agent, or Firm*—Sheridan Ross PC

(57) ABSTRACT

An inflatable pad assembly includes a connecting unit for interconnecting pivotally and detachably first and second inflatable pads such that the second inflatable pad is operable so as to pivot relative to the first inflatable pad between a first position, where one of opposite first and second sides of the first inflatable pad abuts against one of opposite first and second sides of the second inflatable pad, and a second position, where the second inflatable pad is superposed on the first inflatable pad. A third inflatable pad is connected pivotally to the second inflatable pad, and is operable so as to pivot relative to the second inflatable pad between a third position, where the third inflatable pad is received fittingly in a notch in the first side of the second inflatable pad, and a fourth position, where the third inflatable pad is superposed on the second inflatable pad;

wherein said notch in said first side of said second inflatable pad is defined by a wall, said second inflatable pad including a first flap that is fastened to said wall and that is provided with a hook-and-loop fastener, said third inflatable pad including a second flap that is fastened to a side thereof and that is provided with a hook-and-loop fastener, saidi hook-and-loop fasteners of said first and second flaps engaging detachably each other so as to interconnect said first and second flaps, thereby allowing pivoting movement of said third inflatable pad about an assembly of said first and second flaps; and wherein, when said third inflatable pad is disposed at the third position, an assembly of said second and third inflatable pads is rectangular and has a size substantially equal to that of said first inflatable pad.

7 Claims, 5 Drawing Sheets

INFLATABLE PAD ASSEMBLY

CROSS-REFERENCE TO RELATED APPLICATION

This application claims priority of Chinese Application No. 200620054696.7, filed on Jan. 26, 2006.

BACKGROUND OF THE INVENTION

1. Field of the Invention

The invention relates to an inflatable pad assembly, more particularly to an inflatable pad assembly that can be operated in various states of use.

2. Description of the Related Art

FIG. 1 illustrates a conventional unitary inflatable bed 9 that merely serves as a two-layer bed. Therefore, it is desirable to design a multi-functional inflatable pad assembly.

SUMMARY OF THE INVENTION

Therefore, the object of the present invention is to provide an inflatable pad assembly that can be operated in various states of use.

According to the present invention, an inflatable pad assembly comprises:

a first inflatable pad having opposite first and second sides;

a second inflatable pad having a first side formed with a notch, and a second side opposite to the first side of the second inflatable pad;

a connecting unit for interconnecting pivotally and detachably the first and second inflatable pads such that the second inflatable pad is operable so as to pivot relative to the first inflatable pad between a first position, where one of the first and second sides of the first inflatable pad abuts against one of the first and second sides of the second inflatable pad, and a second position, where the second inflatable pad is superposed on the first inflatable pad; and a third inflatable pad connected pivotally to the second inflatable pad and operable so as to pivot relative to the second inflatable pad between a third position, where the third inflatable pad is received fittingly in the notch in the first side of the second inflatable pad, and a fourth position, where the third inflatable pad is superposed on the second inflatable pad.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
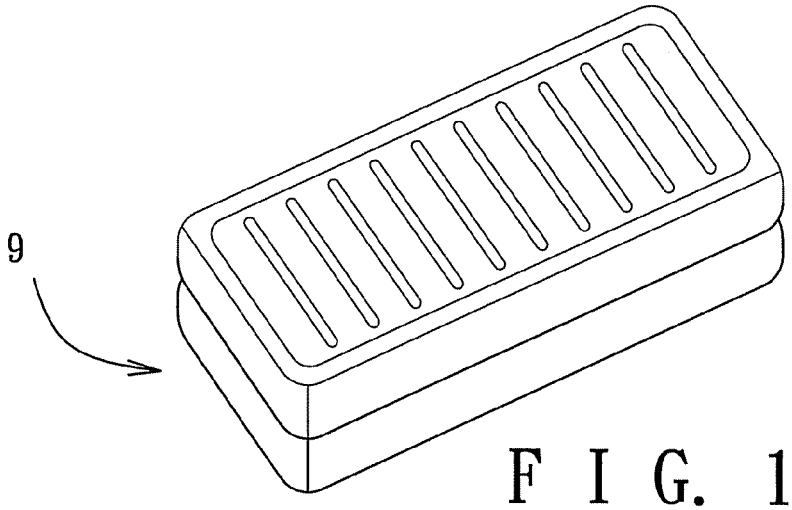
F I G. 1 PRIOR ART
FIG. 1 is a perspective view of a conventional inflatable bed.

Before the present invention is described in greater detail, it should be noted that like elements are denoted by the same reference numerals throughout the disclosure.

Figure 2:
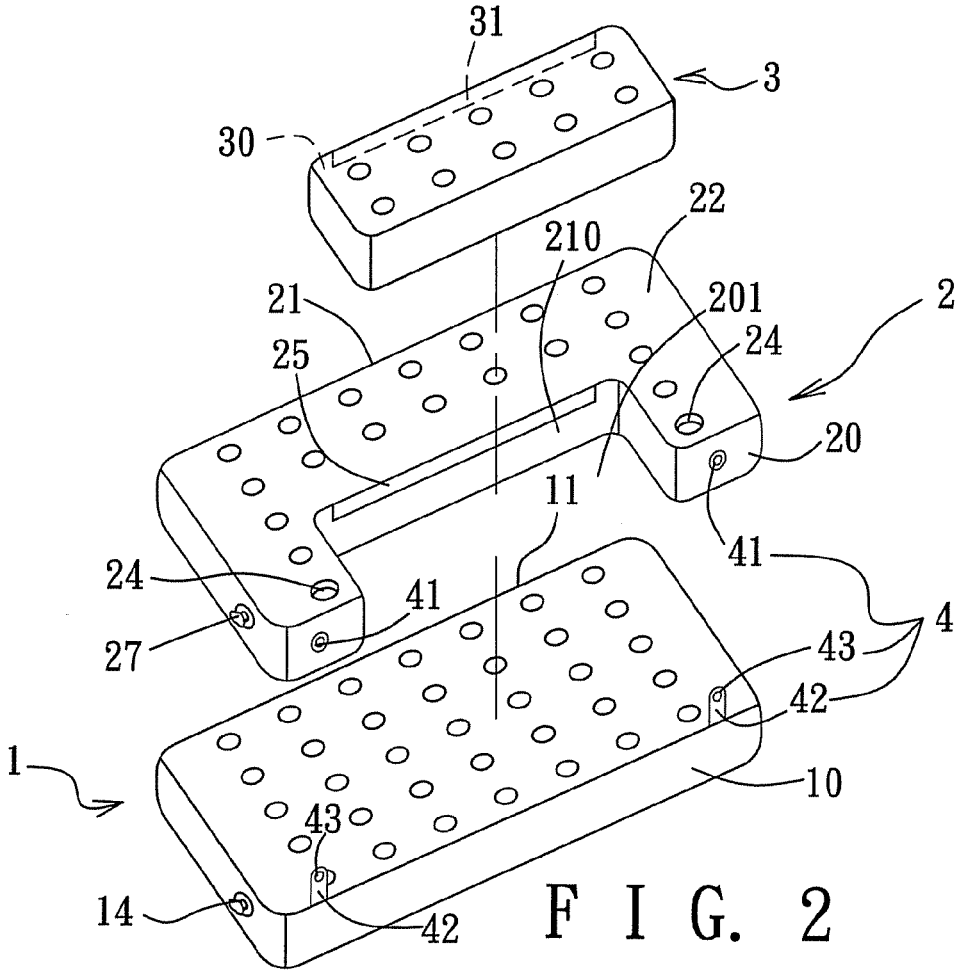
FIG. 2 is an exploded perspective view showing the first preferred embodiment of an inflatable pad assembly according to the present invention.

Referring to FIG. 2, the first preferred embodiment of an inflatable pad assembly according to the present invention is shown to include a first inflatable pad 1, a second inflatable pad 2, a connecting unit, and a third inflatable pad 3.

The first inflatable pad 1 has opposite first and second sides 10, 11, and an air valve 14 disposed thereon.

The second inflatable pad 2 has a first side 20 formed with a notch 201 that is defined by a wall 210, and a second side 21 opposite to the first side 20 of the second inflatable pad 2. The second inflatable pad 2 further has an air valve 27 disposed thereon.

Figure 3:
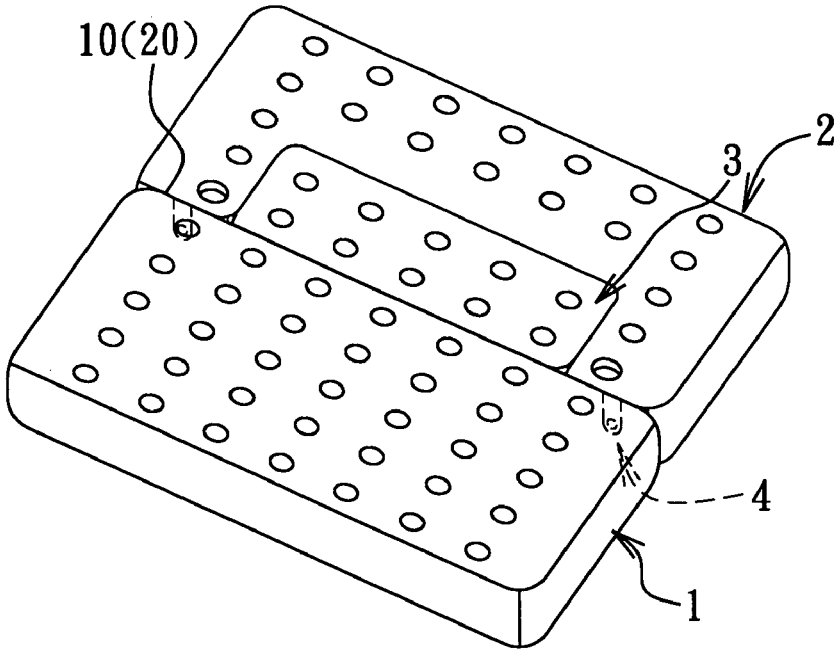
FIG. 3 is a perspective view showing the first preferred embodiment when serving as a single-layer bed.
Figure 4:
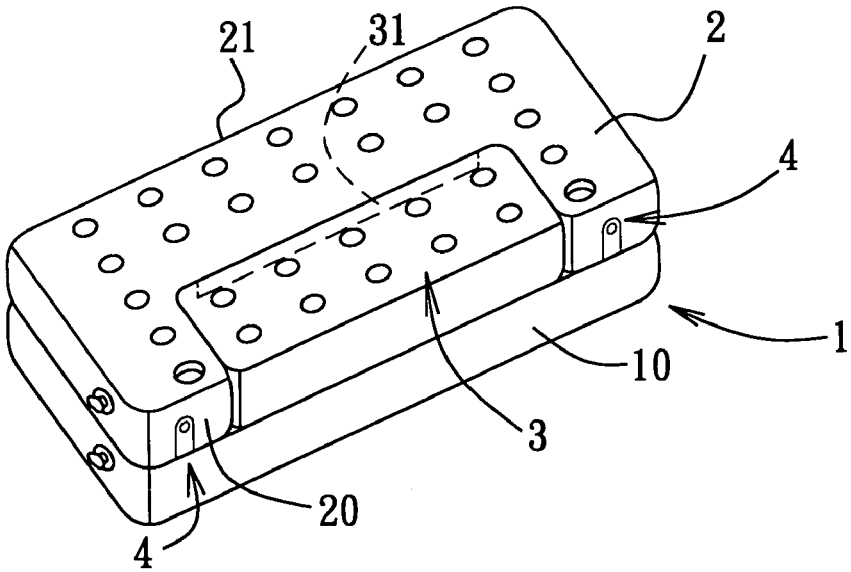
FIG. 4 is a perspective view showing the first preferred embodiment when serving as a two-layer bed.
Figure 5:
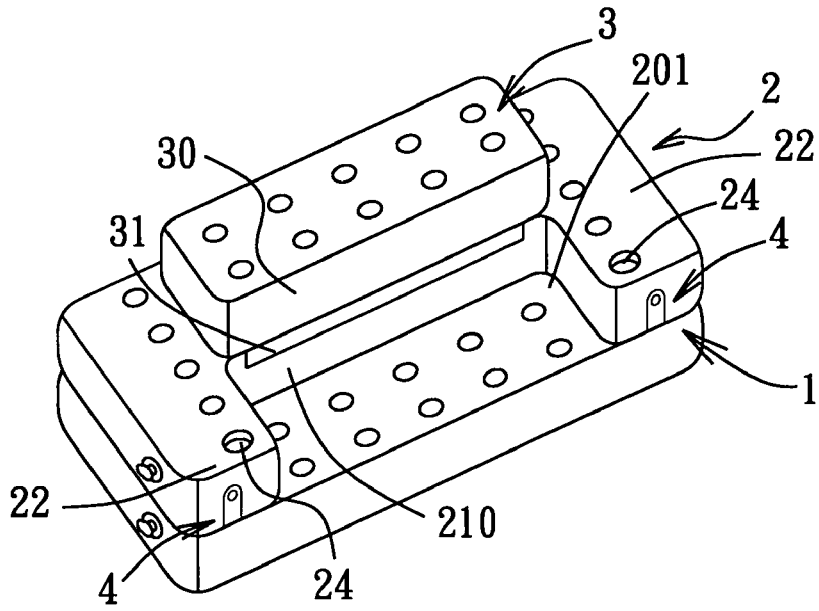
FIG. 5 is a perspective view showing the first preferred embodiment when serving as a sofa.

In this embodiment, the connecting unit interconnects pivotally and detachably the first and second inflatable pads 1, 2 such that the second inflatable pad 2 is operable so as to pivot relative to the first inflatable pad 1 between a first position, where the first side 10 of the first inflatable pad 1 abuts against the first side 20 of the second inflatable pad 2, as shown in FIG. 3, and a second position, where the second inflatable pad 2 is superposed on the first inflatable pad 1, as shown in FIGS. 4 and 5. In this embodiment, the connecting unit includes a pair of opposite snap fastener units 4, each of which includes a female fastener 41 disposed on the first side 20 of the second inflatable pad 2, a strap 42 fastened to the first side 10 of the first inflatable pad 1, and a male fastener 43 disposed fixedly on the strap 42 and engaging detachably the female fastener 41 such that the second side 21 of the second inflatable pad 2 is moved toward the second side 11 of the first inflatable pad 1 when the second inflatable pad 2 is pivoted from the first position to the second position.

The third inflatable pad 3 is connected pivotally to the second inflatable pad 2, and is operable so as to pivot relative to the second inflatable pad 2 between a third position, where the third inflatable pad 3 is received fittingly within the notch 201 in the first side 20 of the second inflatable pad 2, as shown in FIGS. 3 and 4, and a fourth position, where the third inflatable pad 3 is superposed on the second inflatable pad 2, as shown in FIG. 5. In this embodiment, when the third inflatable pad 3 is disposed at the third position, an assembly of the second and third inflatable pads 2, 3 is rectangular, and has a size substantially equal to that of the first inflatable pad 1, as shown in FIG. 3.

Figure 8:
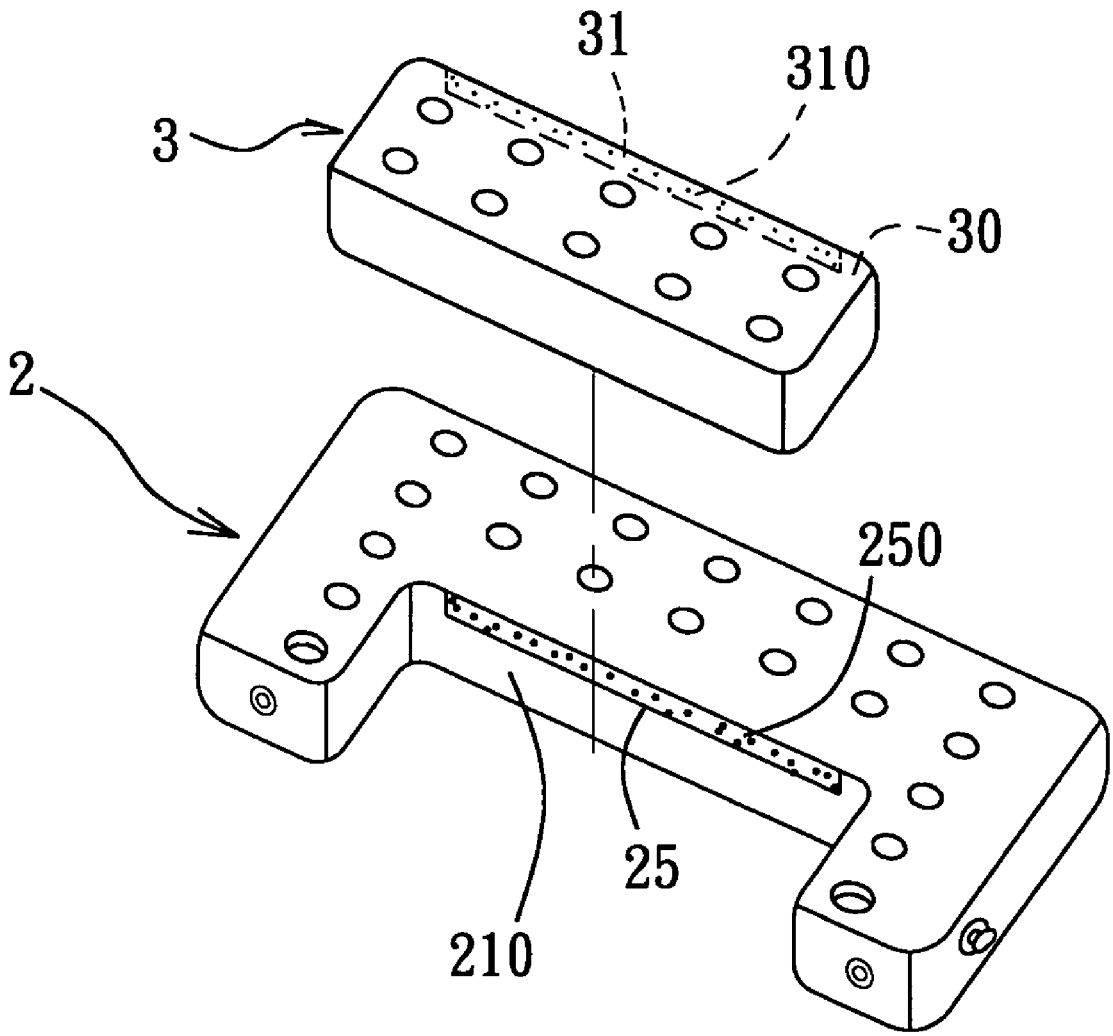
FIG. 8 shows modified second and third inflatable pads.

In this embodiment, the second inflatable pad 2 includes a first flap 25 fastened to the wall 210. The third inflatable pad 3 includes a second flap 31 fastened to a side 30 thereof and connected fixedly to the first flap 25 of the second inflatable pad 2, thereby allowing pivoting movement of the third inflatable pad 3 about an assembly of the first and second flaps 25, 31. Alternatively, as shown in FIG. 8, the first flap 25 of the second inflatable pad 2 is further provided with a hook-and-loop fastener 250. The second flap 31 of the third inflatable pad 3 is further provided with a hook-and-loop fastener 310. As such, the hook-and-loop fasteners 250, 310 of the first and second flaps 25, 31 engage detachably each other so as to interconnect the first and second flaps 25, 31, thereby allowing pivoting movement of the third inflatable pad 3 about the assembly of the first and second flaps 25, 31.

In actual use, when the second and third inflatable pads 2, 3 are disposed respectively at the first and third positions, the inflatable pad assembly serves as a single-layer bed, as shown in FIG. 3. When the second and third inflatable pads 2, 3 are disposed respectively at the second and third positions, the inflatable pad assembly serves as a two-layer bed, as shown in FIG. 4. When the second and third inflatable pads 2, 3 are disposed respectively at the second and fourth positions, the inflatable pad assembly serves as a sofa, as shown in FIG. 5.

The second inflatable pad 2 further has a mounting surface 22 formed with opposite cup-receiving grooves 24 that are disposed adjacent to the notch 201. When the second and the third inflatable pads 2, 3 are disposed respectively at the second and fourth positions (i.e., the inflatable pad assembly serves as a sofa), the mounting surface 22 abuts against the third inflatable pad 3, as shown in FIG. 5.

Figure 6:
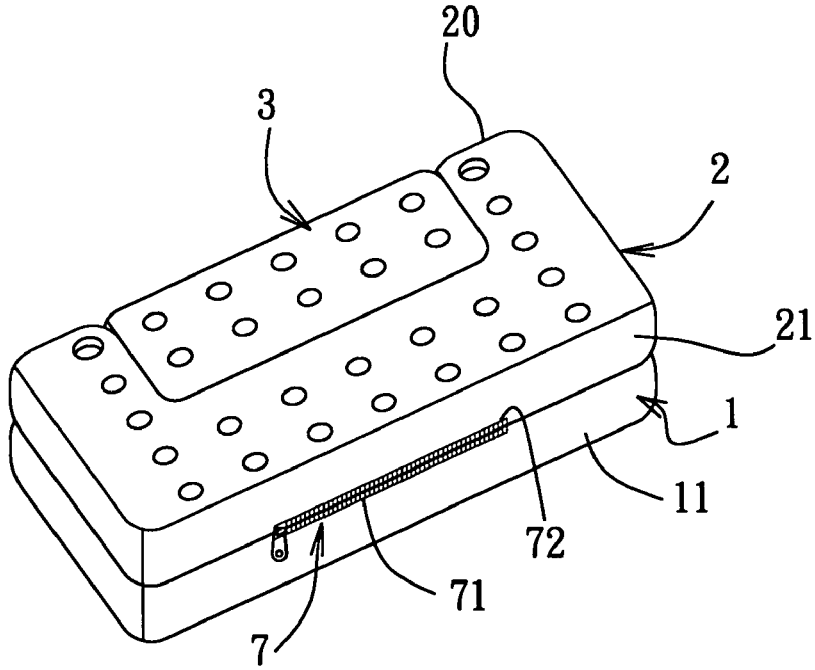
FIG. 6 is a perspective view showing the second preferred embodiment of an inflatable pad assembly according to the present invention, when serving as a two-layer bed.
Figure 7:
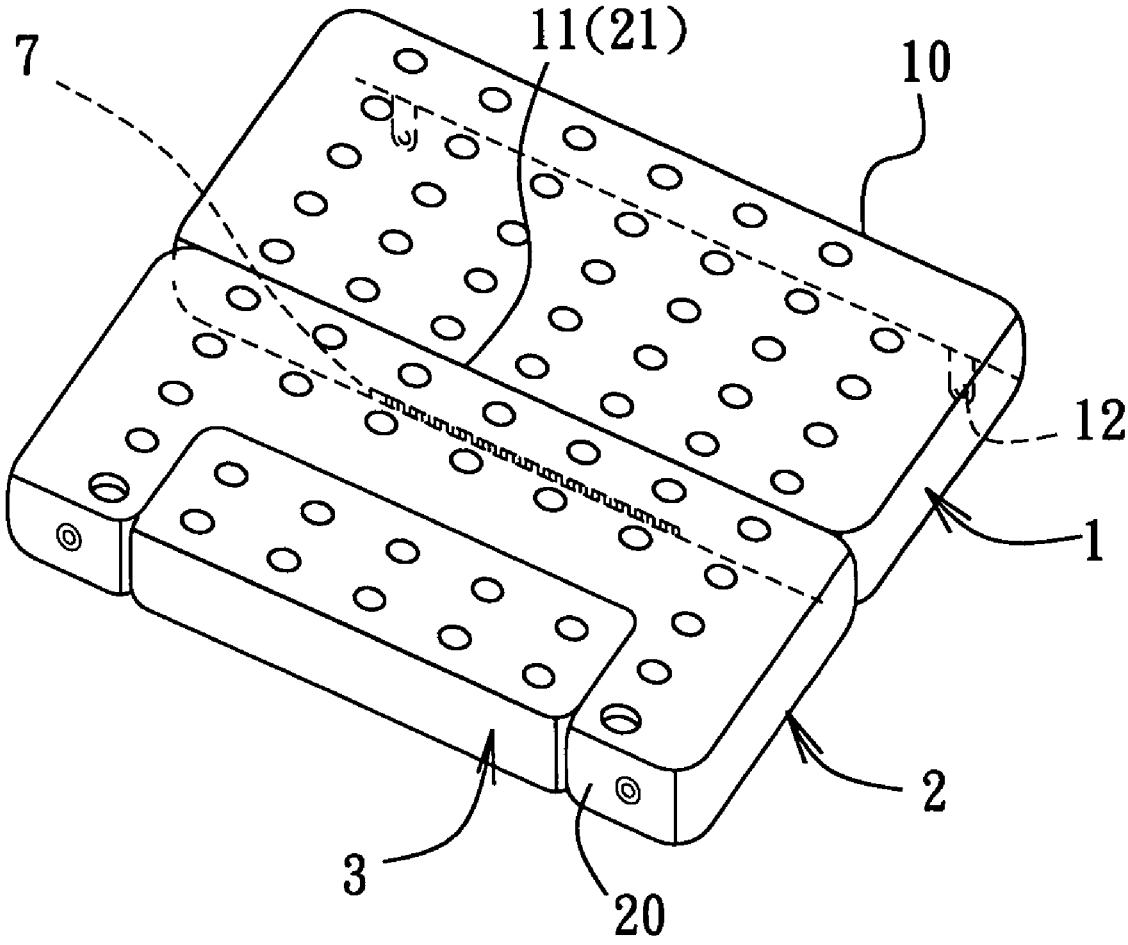
FIG. 7 is a perspective view showing the second preferred embodiment when serving as a single-layer bed.

FIGS. 6 and 7 illustrate the second preferred embodiment of an inflatable pad assembly according to this invention, which is a modification of the first preferred embodiment. In this embodiment, the connecting unit includes a zipper 7 that has two zipper halves 71, 72 disposed respectively on the second sides 11, 21 of the first and second inflatable pads 1, 2 and engaging detachably each other. As such, when the second inflatable pad 2 is disposed at the first position, due to the presence of the zipper 7, it can be operated so that the second sides 11, 21 of the first and second inflatable pads 1, 2 abut against each other, as shown in FIG. 7, such that the first side 20 of the second inflatable pad 2 is moved toward the first side 10 of the first inflatable pad when the second inflatable pad 2 is pivoted from the first position to the second position.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An inflatable pad assembly comprising:

a first inflatable pad having opposite first and second sides;

a second inflatable pad having a first side formed with a notch, and a second side opposite to said first side of said second inflatable pad;

a connecting unit for interconnecting pivotally and detachably said first and second inflatable pads such that said second inflatable pad is operable so as to pivot relative to said first inflatable pad between a first position, where one of said first and second sides of said first inflatable pad abuts against one of said first and second sides of said second inflatable pad, and a second position, where said second inflatable pad is superposed on said first inflatable pad; and a third inflatable pad connected pivotally to said second inflatable pad and operable so as to pivot relative to said second inflatable pad between a third position, where said third inflatable pad is received fittingly in said notch in said first side of said second inflatable pad, and a fourth position, where said third inflatable pad is superposed on said second inflatable pad;

wherein said notch in said first side of said second inflatable pad is defined by a wall, said second inflatable pad including a first flap that is fastened to said wall and that is provided with a hook-and-loop fastener, said third inflatable pad including a second flap that is fastened to a side thereof and that is provided with a hook-and-loop fastener, said hook-and-loop fasteners of said first and second flaps engaging detachably each other so as to interconnect said first and second flaps, thereby allowing pivoting movement of said third inflatable pad about an assembly of said first and second flaps; and wherein, when said third inflatable pad is disposed at the third position, an assembly of said second and third inflatable pads is rectangular and has a size substantially equal to that of said first inflatable pad.

2. The inflatable pad assembly as claimed in claim 1, wherein, when said second inflatable pad is disposed at the first position and when said third inflatable pad is disposed at the third position, said inflatable pad assembly serves as a single-layer bed.

3. The inflatable pad assembly as claimed in claim 1, wherein, when said second inflatable is disposed at the second position and when said third inflatable pad is disposed at the third position, said inflatable pad assembly serves as a two-layer folded bed.

4. The inflatable pad assembly as claimed in claim 1, wherein, when said second inflatable pad is disposed at the second position and when said third inflatable pad is disposed at the fourth position, said inflatable pad assembly serves as a sofa.

5. The inflatable pad assembly as claimed in claim 4, wherein said second inflatable pad has a mounting surface abutting against said third inflatable pad when said second and third inflatable pads are disposed respectively at the second and fourth positions, said mounting surface being formed with a cup-receiving groove that is disposed adjacent to said notch.

6. The inflatable pad assembly as claimed in claim 1, wherein said connecting unit includes a pair of opposite snap fastener units, each of which includes a female fastener disposed on one of said first sides of said first and second inflatable pads, a strap fastened to the other one of said first sides of said first and second inflatable pads, and a male fastener disposed fixedly on said strap and engaging detachably said female fastener such that said second side of said second inflatable pad is moved toward said second side of said first inflatable pad when said second inflatable pad is pivoted from the first position to the second position.

7. The inflatable pad assembly as claimed in claim 1, wherein said connecting unit includes a zipper that has two zipper halves disposed respectively on said second sides of said first and second inflatable pads and engaging detachably each other such that said first side of said second inflatable pad is moved toward said first side of said first inflatable pad when said second inflatable pad is pivoted from the first position to the second position.

* * * * *